US007413080B2

(12) United States Patent
Van House

(10) Patent No.: US 7,413,080 B2
(45) Date of Patent: Aug. 19, 2008

(54) RIGHT ANGLE BLISTER PLUS HEADER CARD PACKAGE

(75) Inventor: Larry Van House, Bound Brook, NJ (US)

(73) Assignee: The Hartz Mountain Corporation, Secaucus, NJ (US)

( * ) Notice: Subject to any disclaimer, the term of this patent is extended or adjusted under 35 U.S.C. 154(b) by 0 days.

(21) Appl. No.: 11/606,561

(22) Filed: Nov. 29, 2006

(65) Prior Publication Data

US 2008/0121546 A1 May 29, 2008

(51) Int. Cl.
*B65D 73/00* (2006.01)

(52) U.S. Cl. ..... 206/470; 206/45.2; 206/806

(58) Field of Classification Search ..... 206/461, 206/464, 470, 471, 806, 736, 751, 752, 766, 206/45.2, 45.21, 45.23, 45.24, 45.25, 45.28, 206/767

See application file for complete search history.

(56) References Cited

U.S. PATENT DOCUMENTS 3,581,885 A * 6/1971 Wald ..... 206/470
4,005,776 A * 2/1977 Seeley ..... 206/470
4,190,151 A 2/1980 Russell
4,667,827 A 5/1987 Calcerano
4,784,268 A * 11/1988 Perchak ..... 206/461
4,842,141 A * 6/1989 Segal ..... 206/462
5,147,035 A * 9/1992 Hartman ..... 206/45.23
5,819,939 A 10/1998 Boyer
5,927,496 A 7/1999 Seaton et al.
6,283,312 B1 9/2001 Edgerton
6,401,932 B1 * 6/2002 Weinstein et al. ..... 206/779
6,675,972 B2 1/2004 Patterson
6,938,770 B2 9/2005 Nittono et al.

* cited by examiner

*Primary Examiner*—Luan K Bui
(74) *Attorney, Agent, or Firm*—Gottlieb, Rackman & Reisman

(57) ABSTRACT

An improved blister package construction is provided. The inventive blister package construction allows for different visual presentations of the packaged products that would otherwise not be achievable with conventional blister packages. The blister package of the invention has one or two thermoplastic blisters designed and positioned on a backing card such that, when the card is folded along a transverse score line, the one or two blisters will lock together and the backing card will be formed into an "L" shaped configuration.

6 Claims, 4 Drawing Sheets

RIGHT ANGLE BLISTER PLUS HEADER CARD PACKAGE

BACKGROUND OF THE INVENTION

This application relates to an improved blister package construction and more particularly, to a blister package construction that enables different visual presentations of the packaged products.

The displayed presentation of merchandise is an important aspect of the retail business world. Display packages must be suitably designed for the effective presentation and marketing of the particular merchandise sold. Stated simply, the ultimate retail purchase decision is made in the aisles of the retail establishment, where the customer encounters the desired goods and various types of display packages.

In order to simplify the act of product purchasing, manufacturers often display their products in packaging which consists of a thermo-formed blister package, sometimes in a clam-shelled design, and sometimes with a paper backing card. This blister package, when made of a transparent plastic, readily permits the customer to see the product directly. Blister packages can contain a single item or multiple items.

In general, standard blister packages that are seen in most retail establishments include a paper-board backing card, to which a thermoformed thermoplastic blister is affixed. Such blister packages, when displayed, simply hang down vertically by use of a pre-formed cut-out or hang hole which is mounted on a display peg. While satisfactory in most merchandise display situations, such a blister card construction may be less than desirable if the product or products being displayed in the blister card are better presented at different unique visual angles.

Accordingly, it is desirable to provide an improved blister package construction which enhances the display of the packaged merchandise.

SUMMARY OF THE INVENTION

Generally speaking, in accordance with the invention, an improved blister package construction is provided. The inventive blister package construction allows for different visual presentations of the packaged products that would otherwise not be achievable with conventional blister packages. In one embodiment, the blister package of the invention has two thermoplastic blisters designed and positioned on a backing card such that, when the card is folded along a transverse score line located between the blisters, the two blisters will lock together and the backing card will be formed into an "L" shaped configuration. In a second embodiment, a single thermoplastic blister is disposed along a backing card; the single blister includes a separating hinge which lies over a transverse score line on the card. This permits folding of the blister package and thus defines two compartments of the single blister located on either side of the separating hinge.

In construction, the blister package of the invention is formed using a flat blister card element having a folding score line and one or two blisters sealed thereto. Inside the one or two blisters is one or more products. During shipment, the blister backing card is disposed in a flat condition so that the blister package can be shipped to the point of display without taking up excessive space in the shipping packaging. When it is desired to place the blister package on display (along a rack or shelf, for example), the flat blister card is folded along the score line with each of the one or two blisters joined together by means of a male-female connection in order to hold the blister package in place at a substantially right angle.

Significantly, the respective male and female elements or undercut sections of the one or two blisters are designed to mate together so that they cannot come apart while the blister package of the invention is on display.

Advantageously, by having the blister package displayed in a folded or a right angle condition, the products can be viewed at different and unique angles as compared to that achievable using a traditional blister package construction.

The backing card of the inventive blister package is formed with a series of hang holes along the top thereof to enable several blister packages to be hung along the same retail shelf peg.

Accordingly, it would be desired to provide an improved display presentation for a blister package.

Another object of the invention is to provide an improved blister package to enable products inside the blister(s) thereof to be viewed at different and unique angles.

A further object of the invention is to provide a blister package construction that is suitable to be shipped to retail locations in a flat condition.

Yet another object of the invention is to provide an improved blister package construction which is foldable such that the backing card thereof forms a substantially right angle while the package is on display.

Still other objects and advantages of the invention will, in part, be obvious and will, in part, be apparent from the following description.

The invention accordingly comprises the features of construction, combination of elements and arrangements of parts as described herein, and the scope of the invention will be indicated in the claims.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENTS

Figure 1A:
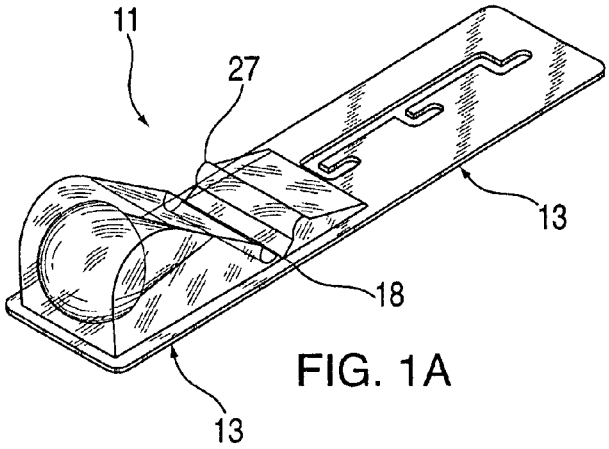
FIG. 1A is a perspective view of a first embodiment of the blister package of the invention in a flat or unfolded condition.
Figure 1B:
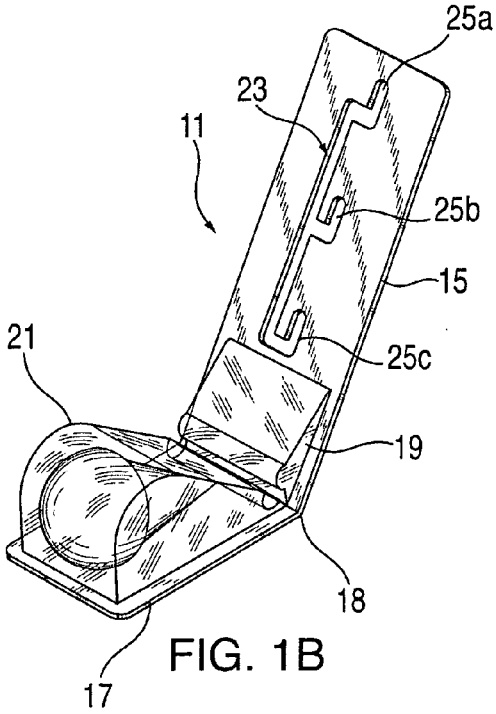
FIG. 1B is a perspective view of a first embodiment of the blister package of the invention in a partially folded condition.
Figure 1C:
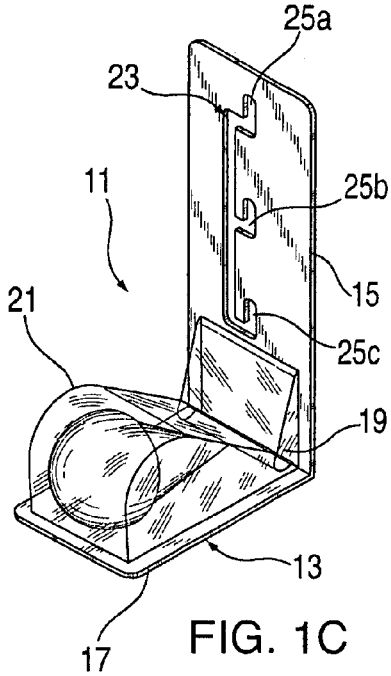
FIG. 1C is a perspective view of a first embodiment of the blister package of the invention in a fully folded condition.
Figure 2A:
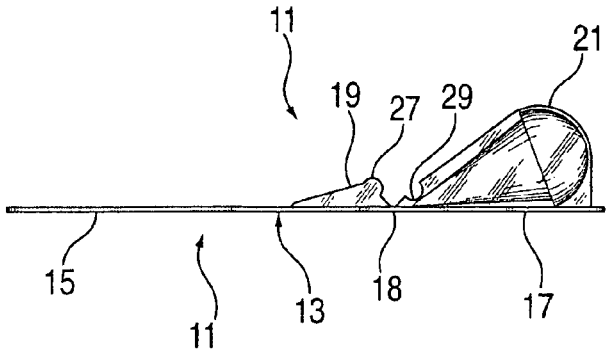
FIG. 2A is a side view of a first embodiment of the blister package of the invention in a flat or unfolded condition.
Figure 2B:
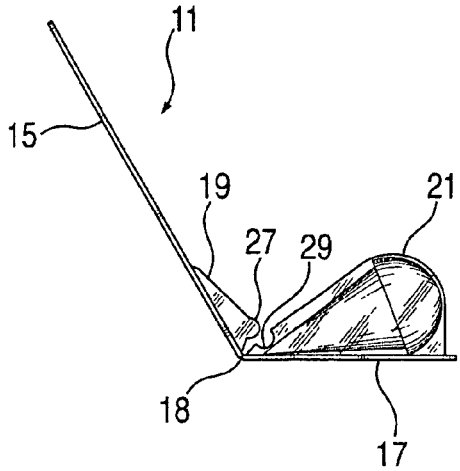
FIG. 2B is a side view of a first embodiment of the blister package of the invention in a partially folded.
Figure 2C:
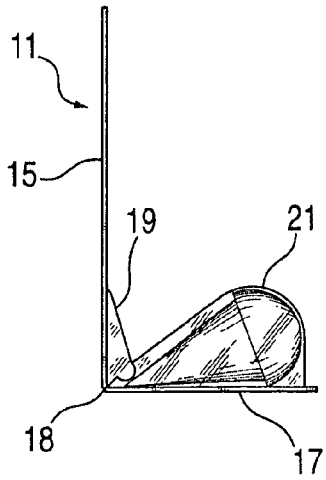
FIG. 2C is a side view of a first embodiment of the blister package of the invention in a fully folded and locked condition.

Referring first to FIGS. 1A, 1B and 1C, as well as FIGS. 2A, 2B and 2C, a first embodiment of a blister package generally indicated at 11 is shown. Blister package 11 is one of a number of like packages which, when filled with product or goods, will be packaged for shipment by the manufacturer and transported to a retail establishment. Package 11 includes a stiff paperboard backing card 13, to which a pair of thermoformed thermoplastic blister elements 19 and 21 are fixed by any conventional technique, such as heat sealing or adhesive attachment. Backing card 13 is divided into a first card element 15 and a second card element 17 for defining a foldable score line 18. As can be appreciated, first thermoplastic blister 19 is affixed to first card element 15 and second thermoplastic blister 21 is affixed to second card element 17.

First card element 15 is formed with a cut-out 23 for defining a series of hang holes 25A, 25B and 25C, each of which is sized to be supported on a retail display peg (not shown). Because card element 15 of blister package 11 is formed with a series of hang holes, as discussed hereinafter, several blister cards may be hung in spaced relationship along a single retail display peg (see FIGS. 3A, 3B and 3C).

Referring still to FIGS. 1A, 1B and 1C, as well as FIGS. 2A, 2B and 2C, it is shown that thermoplastic blister 19 of blister package 11 is formed with an elongated male member or tongue 27, while blister 21 is formed with an elongated female member or a groove 29, which is designed for selective mating engagement with tongue 27. In accordance with the inventive construction, when blister card 13 is folded along score line 18, blisters 19 and 21 will lock together by means of the inter-engagement of tongue 27 and groove 29 (see FIG. 2C). Thus, blister package 11 will be held in "L" shape configuration. The L shape configuration of blister package 11, as shown in FIG. 2C, is advantageous in that the products contained within blisters 19 and 21 are viewed at different and unique angles as compared to products that are exposed in blisters of conventional construction (in a conventional design, the products that are displayed in the blister hangs vertically therewithin).

For example, if a toy such as an artificial mouse-cat toy is displayed in the blister package of the invention, it can be displayed in such a way that it is looking "directly" at the customer, instead of hanging "face" down. This can therefore result in providing a better visual presentation to the prospective customer as he or she searches for a product to purchase.

Although one specific form or shape of blisters 19 and 21 are shown in the drawings, the two blisters can be designed in different ways. For example, each can be constructed to hold a product of similar or different types or shapes. Moreover, the mating sections of the blisters (in the embodiment shown, tongue 27 and groove 29), can be shaped and designed to be round, oblong, or in strip form. What is significant is that two blisters 19 and 21 have cooperating elements which allow them to snap together and stay in such a condition while being displayed at a retail establishment despite the weight or pressure being exerted by the products stored within the blister elements.

Figure 3A:
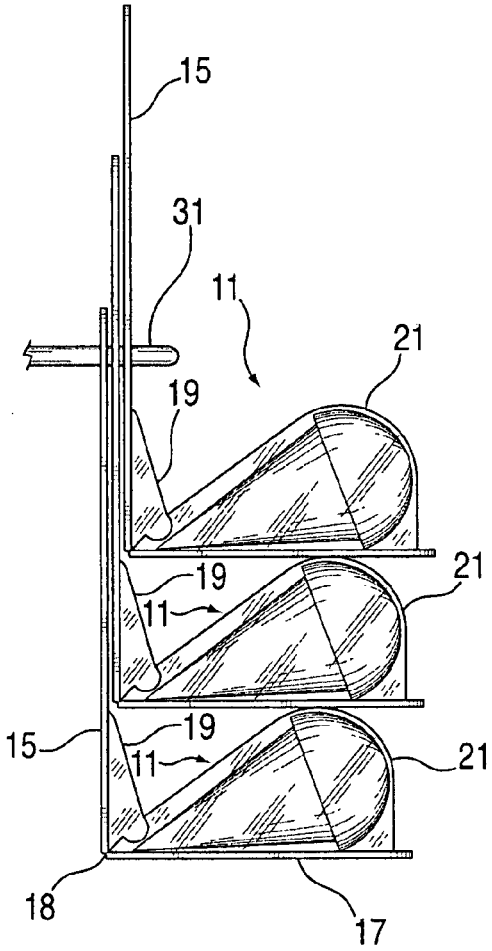
FIG. 3A is a side view of a series of blister packages of the invention in a fully folded and locked condition and stacked so that they can hang on a single shelf peg.
Figure 3B:
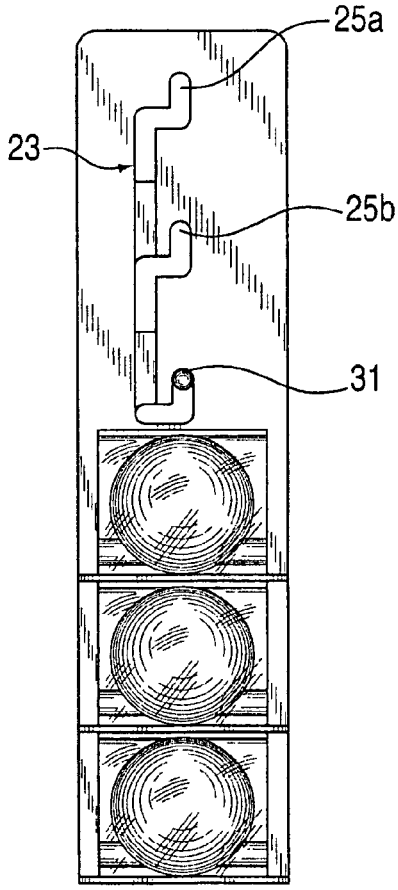
FIG. 3B is a front elevational view of the stacked blister packages shown in FIG. 3A.
Figure 3C:
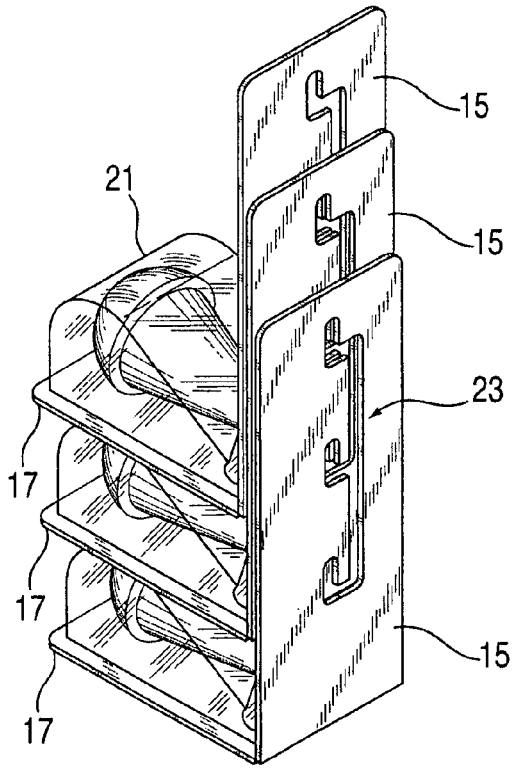
FIG. 3C is a rear perspective view of the stacked blister packages of FIG. 3A.

As discussed above, backing card 13 of the blister package 11 of the invention is made with a series of hang holes 25*a*, 25*b*, 25*c* that allows several of the inventive blister packages to be hung on the same retail display peg 31 in a spaced arrangement so that viewing the products in each of the stacked blister packages is not impeded. This feature is best shown in FIGS. 3A, 3B and 3C, which illustrate the stacked arrangement of a series of blister packages 11 made in accordance with the invention and suitable for being supported along a single display peg 31 (see FIGS. 3A and 3B).

Figure 4:
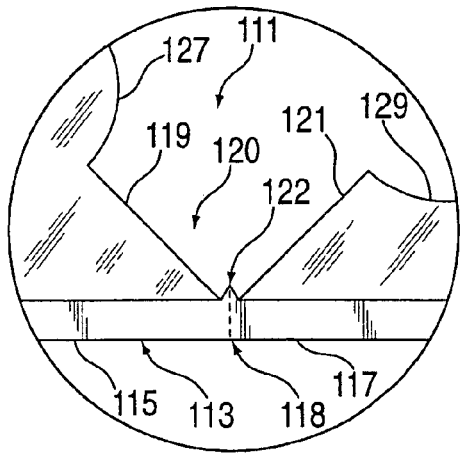
FIG. 4 is an enlarged front view of a second embodiment of the inventive blister package.

In an alternative or second embodiment, as shown in FIG. 4, a blister package generally indicated at 111 is shown, and includes a backing card 113 to which a single blister element 120 is fixed. Backing card 113 is divided into a first card element 115 and a second card element 117 for defining a foldable score line 118. Blister element 120 is affixed to card 13. Blister element 120 includes a first compartment 119, a second compartment 121 and a separating hinge located directly over score line 118 of the card 113. Hinge 122 is in the form of a "Z" and allows blister element 120 to easily fold therealong. Compartment 119 has a tongue 127 and compartment 121 has a groove 129 in which tongue 127 is selectively lockable, as described before.

While the design of the invented blister package can be modified without departing from the inventive concept, the blister package of the invention must have mating sections formed on or in association with the blisters so that the two sections can be selectively coupled together for proper display purposes. As a result of this construction, the product exposed in one of the blisters is disposed vertically while on display while the product disposed in the other of the blisters is disposed horizontally on display.

The invention will now be further defined by the following claims.

The invention claimed is:

1. A packaging display system comprising:

a plurality of foldable blister packages, each package comprising a backing card and first and second components of a blister unit affixed to said card on either side of a fold line, said first blister component having a male member and said second blister component having a female member matable with said male member when said backing card is folded along said fold line;

an extending single display peg on which said plurality of blister packages are selectively hung;

said backing card of each said display package being formed with a series of spaced hang holes such that said plurality of blister packages can be hung in spaced relation with one another along said single display peg when in a folded condition.

2. The system of claim 1, wherein said male and female members lock together when mated.

3. The system of claim 2, wherein said male and female members of each said blister package are designed to remain locked together when said blister is hung on said peg in said folded condition.

4. The system of claim 1, wherein said blister unit comprises a single blister element.

5. The system of claim 1, wherein said blister unit comprises a first blister element that defines said one blister component and a second blister element that defines said other blister component.

6. The system of claim 4, wherein said single blister element includes a hinge component for separating said blister components and disposed over said fold line.

* * * * *